US009511263B1

(12) United States Patent
Parnell

(10) Patent No.: US 9,511,263 B1
(45) Date of Patent: Dec. 6, 2016

(54) THERMOPLASTIC POLYESTER ELASTOMER GOLF BALL CORES

(71) Applicant: Callaway Golf Company, Carlsbad, CA (US)

(72) Inventor: Shane Parnell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 118 days.

(21) Appl. No.: 14/683,434

(22) Filed: Apr. 10, 2015

Related U.S. Application Data

(63) Continuation of application No. 13/803,945, filed on Mar. 14, 2013, now Pat. No. 9,005,052.

(60) Provisional application No. 61/749,761, filed on Jan. 7, 2013.

(51) Int. Cl.

| | |
|---|---|
| ***A63B 37/06*** | (2006.01) |
| ***A63B 37/12*** | (2006.01) |
| ***A63B 37/00*** | (2006.01) |

(52) U.S. Cl.
CPC ..... *A63B 37/0045* (2013.01); *A63B 37/008* (2013.01); *A63B 37/0043* (2013.01); *A63B 37/0064* (2013.01); *A63B 37/0076* (2013.01); *A63B 37/0092* (2013.01)

(58) Field of Classification Search
USPC ..... 473/351–378
See application file for complete search history.

(56) References Cited

U.S. PATENT DOCUMENTS

| | | | | |
|---|---|---|---|---|
| 5,439,227 A * | 8/1995 | Egashira | ..... | A63B 37/0003 473/373 |
| 6,747,100 B2 * | 6/2004 | Ichikawa | ..... | A63B 37/0003 473/378 |

(Continued)

FOREIGN PATENT DOCUMENTS

| | | | | |
|---|---|---|---|---|
| FR | 2909674 A1 * | 6/2008 | ..... | A63B 37/0093 |
| JP | 55060553 A * | 5/1980 | | |
| JP | 10179799 A * | 7/1998 | | |

(Continued)

*Primary Examiner* — Alvin Hunter
(74) *Attorney, Agent, or Firm* — Michael A. Catania; Sonia Lari; Rebecca Hanovice

(57) ABSTRACT

A golf ball having a core layer comprising a thermoplastic polyester elastomer formed from a polytetramethylene glycol with a molecular weight greater than or equal to 1400 g/mol is disclosed herein. In one embodiment, an inner core sphere is the core layer and has a diameter ranging from 0.875 inch to 1.4 inches. The core comprises the inner core, an intermediate core and an outer core. The mantle component comprises an inner mantle and an outer mantle. The cover layer is preferably composed of a thermoplastic polyurethane.

4 Claims, 6 Drawing Sheets

(56) References Cited

U.S. PATENT DOCUMENTS

| | | | | |
|---|---|---|---|---|
| 6,750,299 | B2 * | 6/2004 | Ichikawa | A63B 37/0003 473/378 |
| 7,207,903 | B2 * | 4/2007 | Sullivan | A63B 37/0003 473/376 |
| 7,427,243 | B2 * | 9/2008 | Sullivan | A63B 37/0003 473/378 |
| 7,468,006 | B2 * | 12/2008 | Sullivan | A63B 37/0003 473/376 |
| 7,951,015 | B2 * | 5/2011 | Cavallaro | A63B 37/0003 473/376 |
| 7,973,124 | B2 * | 7/2011 | Maruyama | C08G 63/64 528/303 |
| 8,177,665 | B2 * | 5/2012 | Loper | A63B 37/0003 473/376 |
| 8,182,367 | B2 * | 5/2012 | Nagasawa | A63B 37/0023 473/351 |
| 8,357,060 | B2 * | 1/2013 | Loper | A63B 37/0003 473/376 |
| 8,507,633 | B2 * | 8/2013 | Henze | A43B 1/14 528/44 |
| 8,623,990 | B2 * | 1/2014 | Watanabe | C08J 5/18 428/220 |
| 9,005,052 | B1 * | 4/2015 | Parnell | A63B 37/0051 473/376 |
| 2002/0198064 | A1 * | 12/2002 | Sullivan | A63B 37/0003 473/373 |

FOREIGN PATENT DOCUMENTS

| | | | | |
|---|---|---|---|---|
| JP | 11057064 | A | * | 3/1999 |
| JP | 11169487 | A | * | 6/1999 |
| JP | 11267247 | A | * | 10/1999 |
| JP | 2008178683 | A | * | 8/2008 |
| JP | 2008264038 | A | * | 11/2008 |

* cited by examiner

THERMOPLASTIC POLYESTER ELASTOMER GOLF BALL CORES

CROSS REFERENCES TO RELATED APPLICATIONS

The Present Application is a continuation application of U.S. patent application Ser. No. 13/803,945 filed on Mar. 14, 2013, which claims priority to U.S. Provisional Patent No. 61/755,049, filed on Jan. 13, 2013, both of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention relates to golf ball core materials. More specifically, the present invention relates to thermoplastic polyester elastomer golf ball cores.

Description of the Related Art

When used in golf balls, injection moldable thermoplastic elastomers (TPE) offer significant economic advantages over thermoset polymer systems. This is especially true for golf ball cores where compression molded polybutadiene thermoset systems are typically used. Relatively low conversion costs make TPEs very attractive alternatives to thermoset systems.

Thermoplastic polyester elastomers (TPEE) in particular are well suited for use in golf ball cores. Relative to thermoplastic polyamide elastomers and most thermoplastic polyurethane elastomers, they exhibit high levels of rebound resilience. Relative to ionomers they have a high density reducing the need for modification with high density fillers. Common trade names for these materials include Hytrel from DuPont and Arnitel from DSM.

While TPEEs typically have high rebound resilience, they aren't resilient enough for use in some higher compression golf ball core applications. In addition, they don't quite match the rebound resilience of ionomeric thermoplastic elastomers. This is especially true for higher modulus formulations.

Sullivan et al., U.S. Pat. No. 4,911,451, for a Golf Ball Cover Of Neutralized Polyethylene-acrylic acid) Copolymer, discloses in Table One a golf ball having a compression of below 50 and a cover composed of ionomers having various Shore D hardness values ranging from 50 to 61.

Sullivan, U.S. Pat. No. 4,986,545, for a Golf Ball discloses a golf ball having a Rhiele compression below 50 and a cover having Shore C values as low as 82.

Egashira et al., U.S. Pat. No. 5,252,652, for a Solid Golf Ball, discloses the use of a zinc pentachlorothiophenol in a core of a golf ball.

Pasqua, U.S. Pat. No. 5,721,304, for a Golf Ball Composition, discloses a golf ball with a core having a low compression and the core comprising calcium oxide.

Sullivan, et al., U.S. Pat. No. 5,588,924, for a Golf Ball discloses a golf ball having a PGA compression below 70 and a COR ranging from 0.780 to 0.825.

Sullivan et al., U.S. Pat. No. 6,142,886, for a Golf Ball And Method Of Manufacture discloses a golf ball having a PGA compression below 70, a cover Shore D hardness of 57, and a COR as high as 0.794.

Tzivanis et al., U.S. Pat. No. 6,520,870, for a Golf Ball, discloses a golf ball having a core compression less than 50, a cover Shore D hardness of 55 or less, and a COR greater than 0.80.

The prior art fails to disclose a multiple layer golf ball with a multiple layer core that have high rebound resilience.

BRIEF SUMMARY OF THE INVENTION

The goal of this invention is to increase the rebound resilience of TPEEs for use in injection molded golf ball core layers. Higher core resilience will result in higher golf ball C.O.R., higher ball launch velocities, and ultimately more ball distance. Higher rebound resilience will also allow TPEEs to compete with ionomeric thermoplastic elastomers for use in golf ball core layers, increasing design freedom for the golf ball designer.

One aspect of the present invention is a core layer for a golf ball comprising a thermoplastic polyester elastomer formed from a polytetramethylene glycol with a molecular weight greater than or equal to 1400 g/mol.

Another aspect of the present invention is a multi-layer golf ball. The golf ball includes a core, a mantle layer and a cover layer. The core comprises an inner core sphere, an intermediate core layer and an outer core layer. The inner core sphere comprises a thermoplastic polyester elastomer formed from a polytetramethylene glycol with a molecular weight greater than or equal to 1400 g/mol and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer. The mantle layer is disposed over the core, comprises an ionomer material and has a Shore D hardness greater than 55. The cover layer is disposed over the mantle layer, comprises a thermoplastic polyurethane material and has a Shore A hardness less than 100. The golf ball has a diameter of at least 1.68 inches. The mantle layer is harder than the outer core layer, the outer core layer is harder than the intermediate core layer, the intermediate core layer is harder than the inner sphere, and the cover layer is softer than the mantle layer.

Another aspect of the present invention is a multi-layer core and multi-layer mantle golf ball. The golf ball includes a core, a mantle layer and a cover layer. The core comprises an inner core sphere, an intermediate core layer and an outer core layer. The inner core sphere comprises a thermoplastic polyester elastomer formed from a polytetramethylene glycol with a molecular weight greater than or equal to 1400 g/mol and has a diameter ranging from 0.875 inch 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer. The inner mantle layer is disposed over the core, comprises an ionomer material and has a Shore D hardness greater than 55. The outer mantle layer is disposed over the inner mantle layer, comprises an ionomer material and has a Shore D hardness greater than 60. The cover layer is disposed over the mantle layer, comprises a thermoplastic polyurethane material and has a Shore A hardness less than 100. The golf ball has a diameter of at least 1.68 inches. The outer mantle layer is harder than the inner mantle layer, the inner mantle layer is harder than the outer core layer, the outer core layer is harder than the intermediate core layer, the intermediate core layer is harder than the inner sphere, and the cover layer is softer than the outer mantle layer.

Yet another aspect of the present invention is a dual core, dual mantle golf ball. The golf ball comprises a core, an inner mantle layer, an outer mantle layer and a cover. The core comprises an inner core and an outer core disposed over the inner core. The inner core has a deflection of at least 0.230 inch under a load of 220 pounds, and the outer core has a deflection of at least 0.800 inch under a load of 200 pounds. The inner core comprises a thermoplastic polyester elastomer formed from a polytetramethylene glycol with a molecular weight greater than or equal to 1400 g/mol and the outer core comprises a polybutadiene material. The inner mantle layer is disposed over the outer core. The inner mantle layer has a thickness ranging from 0.030 inch to 0.070 inch. The inner mantle layer comprises an ionomer material and has a plaque Shore D hardness ranging from 55 to 65. The outer mantle layer is disposed over the inner mantle layer. The outer mantle layer has a thickness ranging from 0.025 inch to 0.040 inch, comprises an ionomer material, and has a plaque Shore D hardness ranging from 65 to 71. The cover layer is disposed over the outer mantle layer. The cover has a thickness ranging from 0.025 inch to 0.040 inch, is composed of a thermoplastic polyurethane material, has a plaque Shore D hardness ranging from 40 to 50, and an on cover Shore D hardness less than 56. The golf ball has a diameter of at least 1.68 inches and a coefficient of restitution of at least 0.79.

Preferably, the golf ball cover is composed of a thermoplastic polyurethane/polyurea material. The golf ball cover preferably has a thickness ranging from 0.015 inch to 0.045 inch. Each mantle layer is preferably composed of an ionomer material. Alternatively, each mantle layer is composed of a blend of ionomer materials. Alternatively, at least one of the mantle layers is composed of a highly neutralized ionomer material. The combined mantle layers preferably have a thickness ranging from 0.030 inch to 0.075 inch, and most preferably less than 0.067 inch. The core preferably has a diameter ranging from 1.40 inches to 1.64 inches. Preferably, the golf ball has a coefficient of restitution greater than 0.79.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
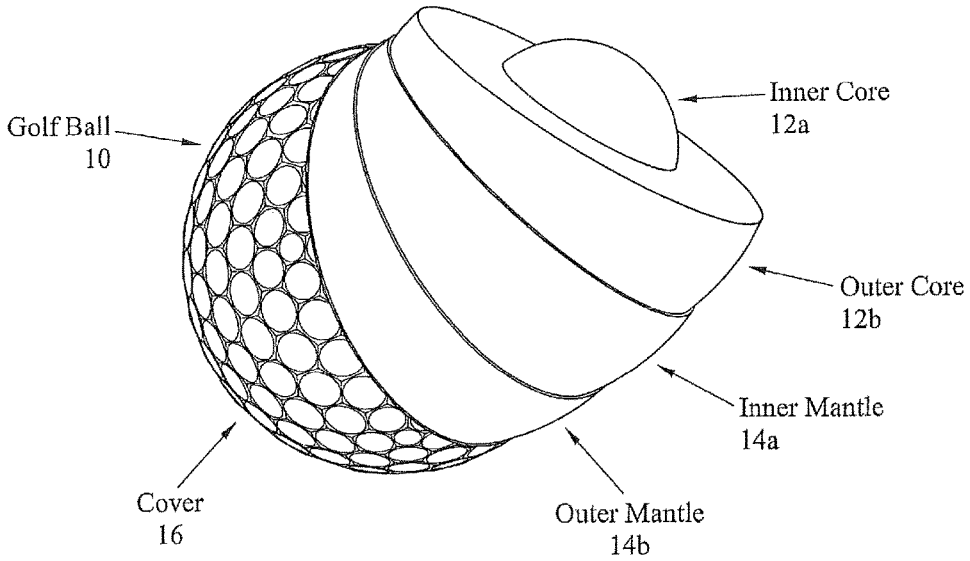
FIG. 1 is an exploded partial cut-away view of a golf ball.
Figure 2:
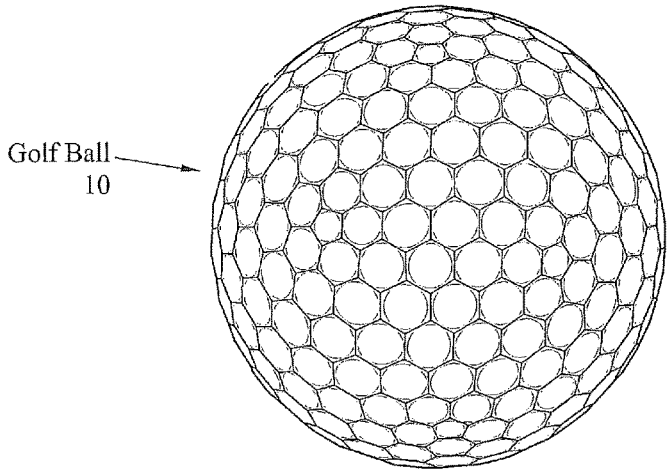
FIG. 2 is top perspective view of a golf ball.
Figure 3:
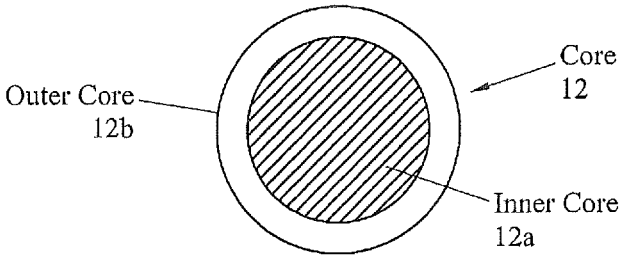
FIG. 3 is a cross-sectional view of a core component of a golf ball.
Figure 4:
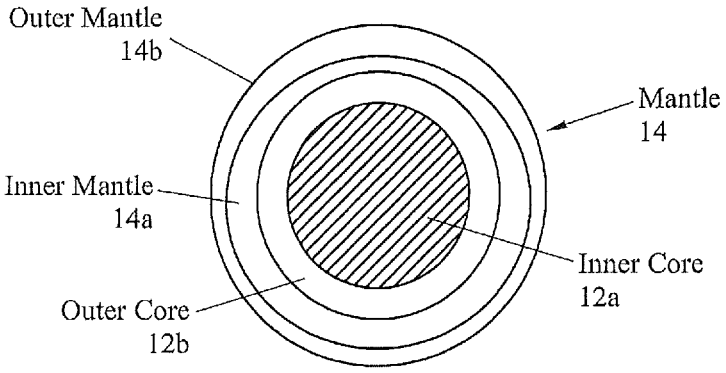
FIG. 4 is a cross-sectional view of a core component and a mantle component of a golf ball.

The present invention is directed to a golf ball having multiple layers.

In this study, several thermoplastic polyurethane (TPU) formulations synthesized from low free isocyanate content prepolymers (LFP) were injection molded as golf ball cover layers, processed through finish, and characterized. For comparison, similar TPU formulations synthesized with the more industrially common one-shot polymerization method were also included. Regardless of formulation chemistry, cover layers molded from LFP polymerized TPU exhibited no observable weld lines (a.k.a. 'pin gap separation' measured with dirt test) around the poles of the ball where pins from the injection molding process held the insert during cover molding. In contrast, cover layers molded from one-shot polymerized TPU did exhibit weld lines. At comparable melt flow index, higher machine injection pressures were also observed for the latter.

TPEEs are typically synthesized by ester interchange of a long chain glycol and a short chain glycol with the methyl ester of a dicarboxylic acid. Typical building blocks include polytetramethylene glycol (PTMO), tetramethylene glycol, and dimethyl terephthalate, respectively. PTMO with a number average molecular weight ($M_n$) of ca. 1000 g/mol is commonly used.

In this invention, TPEEs are made from PTMO with a $M_n \geq 1400$ g/mol. Higher molecular weight PTMO will increase the overall degree of solid state phase separation in these materials and as with thermoplastic polyurethane elastomers this will increase rebound resilience.

Use PTMO with $M_n \geq 1400$ g/mol to improve rebound resilience of TPEEs in injection molded golf ball core layers.

The golf ball 10 comprises a core 11, a mantle 14 and a cover 16. The core 11 comprises an inner core sphere 11*a* and an outer core layer 11*b*. The mantle 14 comprises an inner mantle layer 14*a*, and an outer mantle layer 14*b*.

In a first preferred embodiment, the inner mantle layer 14*a* is composed of a HPF material from DuPont Chemical. A preferred material is HPF 1000. AN alternative material is HPF 2000. The outer mantle layer 14*b* is preferably comprised of a high acid (i.e. greater than 16 weight percent acid) ionomer resin or high acid ionomer blend. Preferably, the outer mantle layer 14*b* is comprised of a blend of two or more high acid (i.e., at least 16 weight percent acid) ionomer resins neutralized to various extents by different metal cations. The mantle layers may or may not include a metal stearate (e.g., zinc stearate) or other metal fatty acid salt. The purpose of the metal stearate or other metal fatty acid salt is to lower the cost of production without affecting the overall performance of the finished golf ball. In a second embodiment, the inner layer 14 is comprised of a low acid (i.e., 16 weight percent acid or less) ionomer blend. Preferably, the inner layer is comprised of a blend of two or more low acid (i.e., 16 weight percent acid or less) ionomer resins neutralized to various extents by different metal cations. The inner cover layer may or may not include a metal stearate (e.g., zinc stearate) or other metal fatty acid salt.

Two principal properties involved in golf ball performance are resilience and hardness. Resilience is determined by the coefficient of restitution (C.O.R.), the constant "e" which is the ratio of the relative velocity of two elastic spheres after direct impact to that before impact. As a result, the coefficient of restitution ("e") can vary from 0 to 1, with 1 being equivalent to an elastic collision and 0 being equivalent to an inelastic collision.

Resilience, along with additional factors such as club head speed, angle of trajectory and ball configuration (i.e., dimple pattern) generally determine the distance a ball will travel when hit. Since club head speed and the angle of trajectory are factors not easily controllable by a manufacturer, factors of concern among manufacturers are the coefficient of restitution (C.O.R.) and the surface configuration of the ball.

A preferred embodiment of a golf ball 10 is shown in FIGS. 1-5. The golf ball 10 comprises an inner core 12*a*, an outer core 12*b*, an inner mantle 14*a*, an outer mantle 14*b* and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

The golf ball preferably has an aerodynamic such as disclosed in Ogg, U.S. Pat. No. 6,461,253 for an Aerodynamic Surface Geometry For A Golf Ball, which is hereby incorporated by reference in its entirety. The golf ball alternatively has an aerodynamic such as disclosed in Simonds et al, U.S. Pat. No. 7,607,997 for a Low Volume Cover For A Golf Ball, which is hereby incorporated by reference in its entirety. The golf ball alternatively has an aerodynamic such as disclosed in Ogg, U.S. Pat. No. 7,083,534 for an Aerodynamic Surface Geometry For A Golf Ball, which is hereby incorporated by reference in its entirety.

The cover 16 is preferably composed of a thermoplastic polyurethane material, and preferably has a thickness ranging from 0.025 inch to 0.04 inch, and more preferably ranging from 0.03 inch to 0.04 inch. The material of the cover 16 preferably has a Shore D plaque hardness ranging from 30 to 60, and more preferably from 40 to 50. The Shore D hardness measured on the cover 16 is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is disclosed in Melanson, U.S. Pat. No. 7,641,841 for a Method For Treating Thermoplastic Polyurethane Golf Ball Covers, which is hereby incorporated by reference in its entirety. Alternatively, the golf ball preferably has a thermoplastic polyurethane cover, such as disclosed in Dewanjee et al., U.S. Pat. No. 7,785,522 for a Cross-Linked Thermoplastic Polyurethane/Polyurea And Method Of Making Same, which is hereby incorporated by reference in its entirety. Alternatively, the golf ball preferably has a thermoplastic polyurethane cover, such as disclosed in Matroni et al., U.S. Pat. No. 7,867,111 for a Golf Ball, which is hereby incorporated by reference in its entirety.

The mantle component 14 is preferably composed of the inner mantle layer 14*a* and the outer mantle layer 14*b*. The mantle component 14 preferably has a thickness ranging from 0.05 inch to 0.15 inch, and more preferably from 0.06 inch to 0.08 inch. The outer mantle layer 14*b* is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer 14*a* is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer 14*a* is preferably composed of a HPF 1000 material or a HPF 2000 material. The inner mantle layer 14*a* preferably has a Shore D hardness ranging from 35-55, a thickness ranging from 0.030 to 0.075 inch, and a flexural modulus ranging from 10-45 kpsi. Alternatively, the inner mantle layer 14*b* is composed of a material such as disclosed in Kennedy, III et al., U.S. Pat. No. 7,361,101 for a Golf Ball And Thermoplastic Material, which is hereby incorporated by reference in its entirety.

The outer mantle layer 14*b* is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer 14*b* preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core 12, the inner mantle layer 14*a* and the outer mantle layer 14*b* preferably ranges from 38 grams to 43 grams, more preferably from 39 to 41 grams, and is most preferably approximately 41 grams.

In an alternative embodiment, the inner mantle layer 14*a* is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer 14*a* has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer 14*b* is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b* preferably has a Shore D plaque hardness ranging preferably from 35 to 77, more preferably from 36 to 44, a most preferably approximately 40. The thickness of the outer mantle layer 14*b* preferably ranges from 0.025 inch to 0.100 inch, and more preferably ranges from 0.070 inch to 0.090 inch.

In yet another embodiment wherein the inner mantle layer 14*a* is thicker than the outer mantle layer 14*b* and the outer mantle layer 14*b* is harder than the inner mantle layer 14*a*, the inner mantle layer 14*a* is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer 14*a* has a Shore D plaque hardness ranging preferably from 30 to 77, more preferably from 30 to 50, and most preferably approximately 40. In this embodiment, the material for the outer mantle layer 14*b* has a Shore D plaque hardness ranging preferably from 40 to 77, more preferably from 50 to 71, and most preferably approximately 67. In this embodiment, the thickness of the inner mantle layer 14*a* preferably ranges from 0.030 inch to 0.090 inch, and the thickness of the outer mantle layer 14*b* ranges from 0.025 inch to 0.070 inch.

Preferably the inner core 12*a* has a diameter ranging from 0.75 inch to 1.40 inches, more preferably from 0.85 inch to 1.05 inch, and most preferably approximately 0.95 inch.

Preferably the outer core 12*b* has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 6:
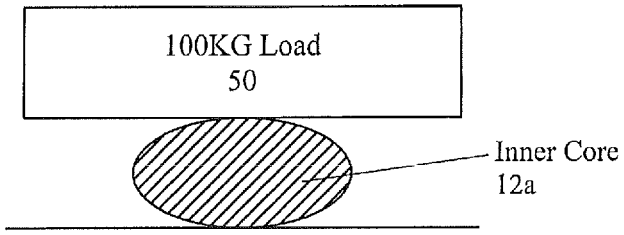
FIG. 6 is a cross-sectional view of an inner core layer under a 100 kilogram load.
Figure 7:
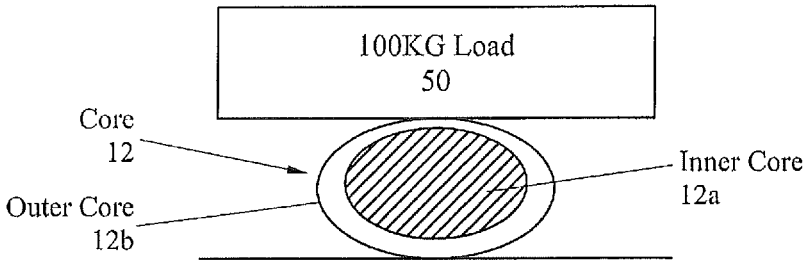
FIG. 7 is a cross-sectional view of a core under a 100 kilogram load.

Preferably the inner core 12*a* has a deflection of at least 0.230 inch under a load of 220 pounds, and the core 12 has a deflection of at least 0.080 inch under a load of 200 pounds. As shown in FIGS. 6 and 7, a mass 50 is loaded onto an inner core 12*a* and a core 12. As shown in FIGS. 6 and 7, the mass is 100 kilograms, approximately 220 pounds. Under a load of 100 kilograms, the inner core 12*a* preferably has a deflection from 0.230 inch to 0.300 inch. Under a load of 100 kilograms, preferably the core 12 has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core 12*a* ranges from 4 millimeters to 7 millimeters and more preferably from 5 millimeters to 6.5 millimeters. The dual core deflection differential allows for low spin off the tee to provide greater distance, and high spin on approach shots.

Figure 5:
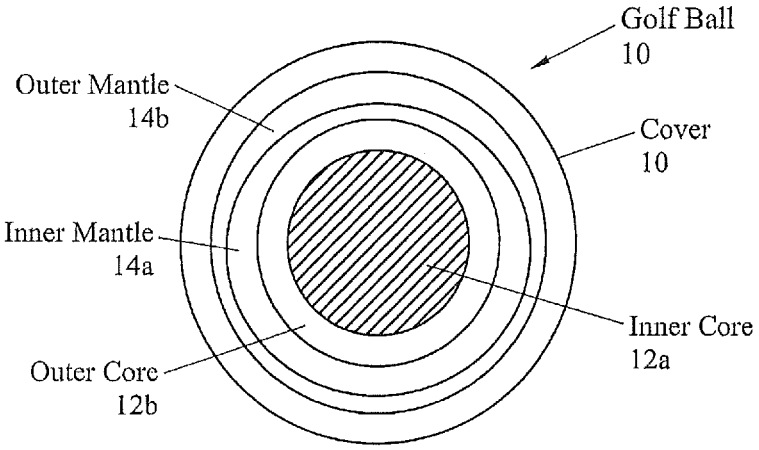
FIG. 5 is a cross-sectional view of an inner core layer, an outer core layer, an inner mantle layer, an outer mantle layer and a cover layer of a golf ball.
Figure 5A:
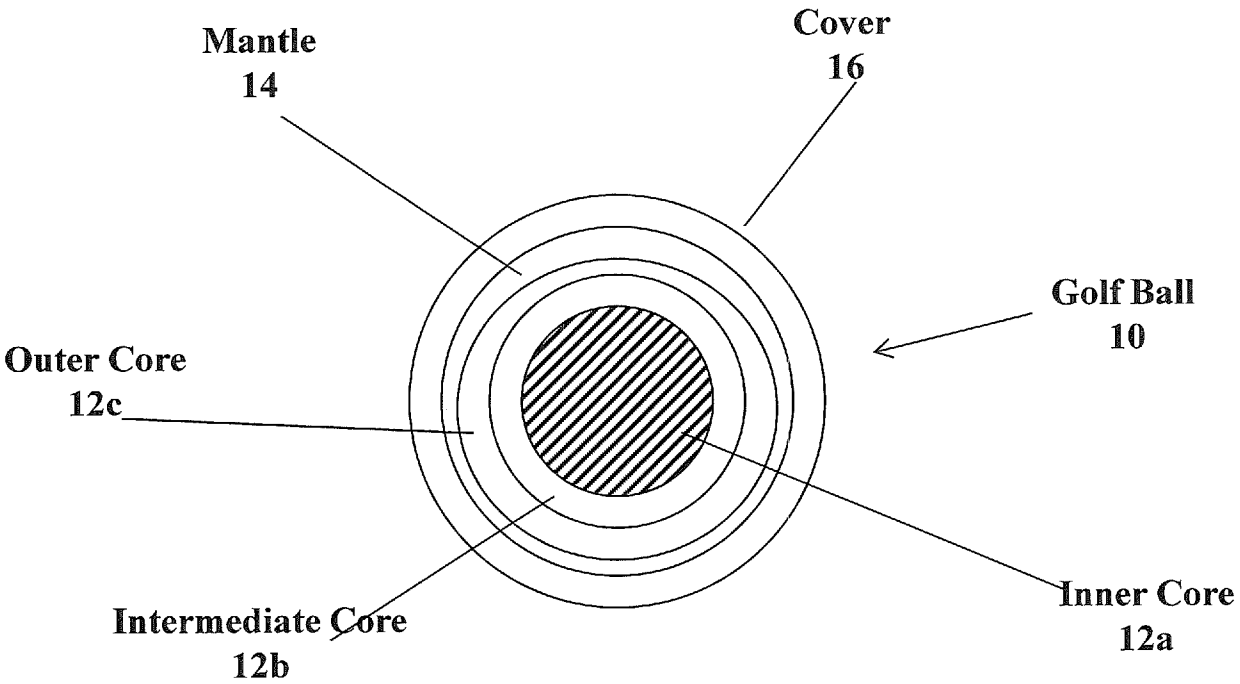
FIG. 5A is a cross-sectional view of an inner core layer, an intermediate core, an outer core layer, a mantle layer and a cover layer of a golf ball.

In an alternative embodiment of the golf ball shown in FIG. 5A, the golf ball 10 comprises an inner core 12*a*, an intermediate core 12*b*, an outer core 12*b*, a mantle 14 and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

In this embodiment, the golf ball 10 comprises a core 12, a mantle layer 14 and a cover layer 16. The core 12 comprises an inner core sphere 12*a*, an intermediate core layer 12*b* and an outer core layer 12*c*. The inner core sphere 12*a* comprises a a thermoplastic polyester elastomer formed from a polytetramethylene glycol with a molecular weight greater than or equal to 1400 g/mol and has a diameter ranging from 0.875 inch to 1.4 inches. The intermediate core layer 12*b* is composed of a highly neutralized ionomer and has a Shore D hardness less than 40. The outer core layer 12*c* is composed of a highly neutralized ionomer and has a Shore D hardness less than 45. A thickness of the intermediate core layer is greater than a thickness of the outer core layer. The mantle layer 14 is disposed over the core 12, comprises an ionomer material and has a Shore D hardness greater than 55. The cover layer 16 is disposed over the mantle layer 14, comprises a thermoplastic polyurethane material and has a Shore A hardness less than 100. The golf ball 10 has a diameter of at least 1.68 inches. The mantle layer 14 is harder than the outer core layer 12*c*, the outer core layer 12*c* is harder than the intermediate core layer 12*b*, the intermediate core layer 12*b* is harder than the inner core sphere 12*a*, and the cover layer 16 is softer than the mantle layer 14.

Figure 8:
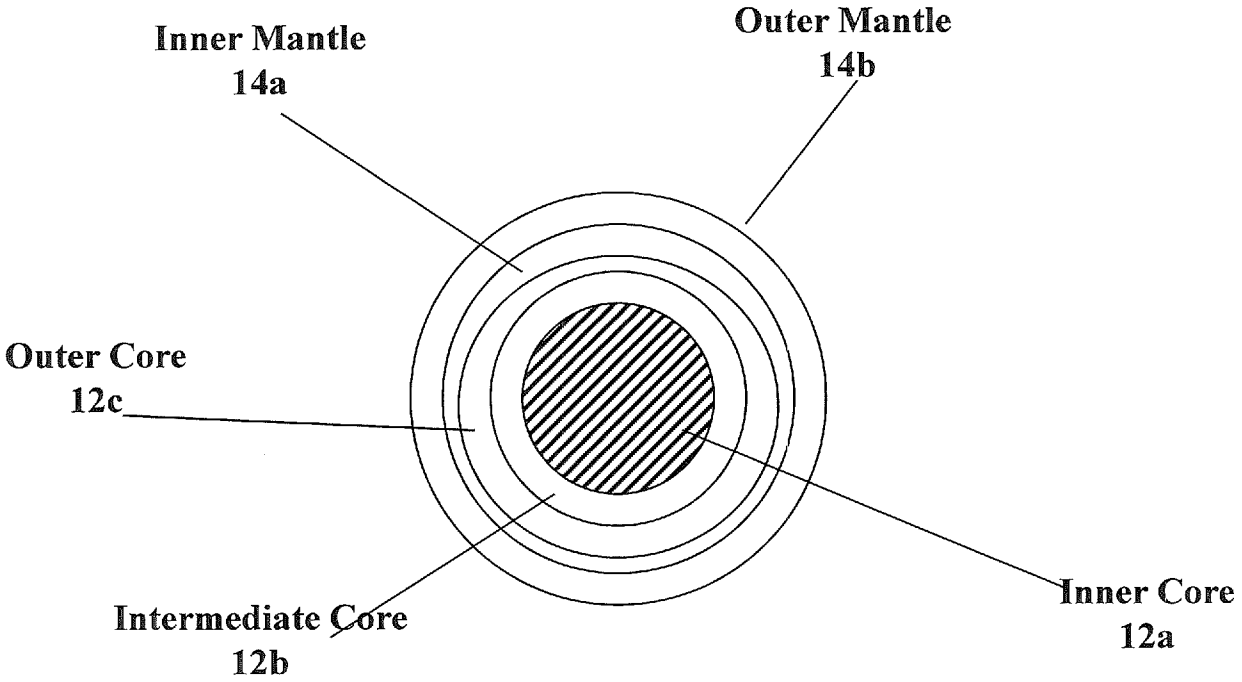
FIG. 8 is a cross-sectional view of a core component and a mantle component of a golf ball.
Figure 9:
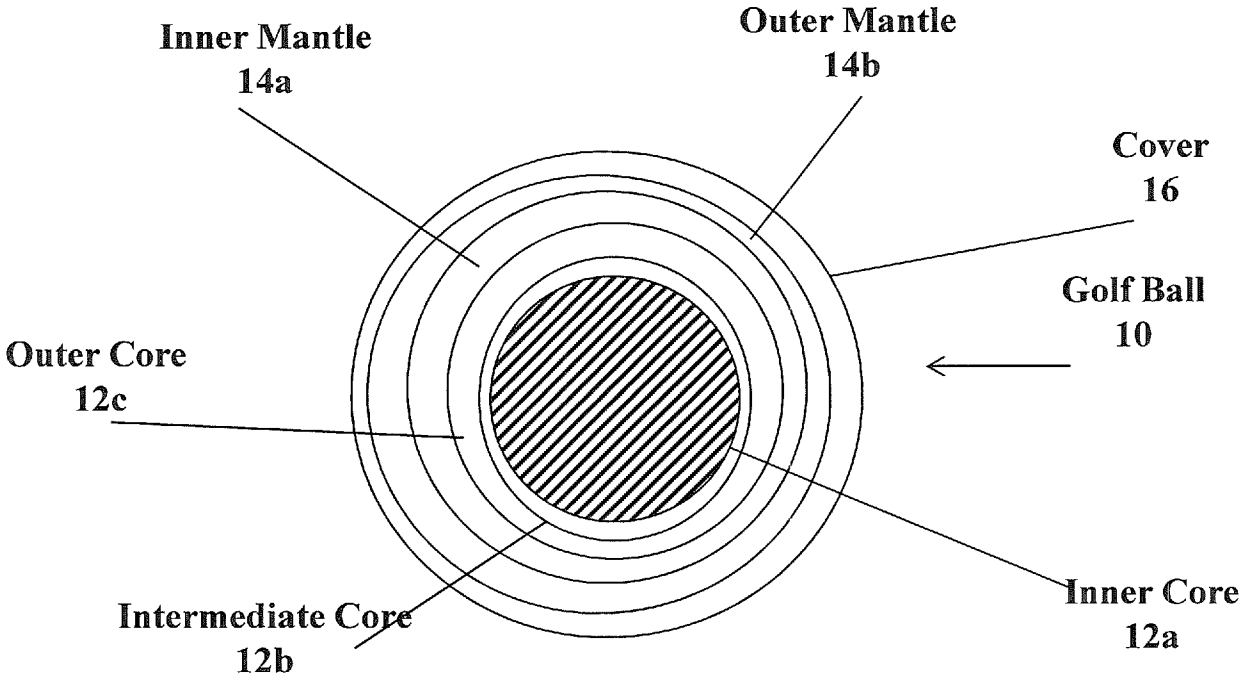
FIG. 9 is a cross-sectional view of a core component, the mantle component and a cover layer of a golf ball.

In another embodiment, shown in FIGS. 8 and 9, the golf ball 10 has a multi-layer core 12 and multi-layer mantle 14. The golf ball 10 includes a core 12, a mantle component 14 and a cover layer 16. The core 12 comprises an inner core sphere 12*a*, an intermediate core layer 12*b* and an outer core layer 12*c*. The inner core sphere 12*a* comprises a a thermoplastic polyester elastomer formed from a polytetramethylene glycol with a molecular weight greater than or equal to 1400 g/mol and has a diameter ranging from 0.875 inch to 1.4 inches. The intermediate core layer 12*b* is composed of a highly neutralized ionomer and has a Shore D hardness less than 40. The outer core layer 12*c* is composed of a highly neutralized ionomer and has a Shore D hardness less than 45. A thickness of the intermediate core layer 12*b* is greater than a thickness of the outer core layer 12*c*. The inner mantle layer 14*a* is disposed over the core 12, comprises an ionomer material and has a Shore D hardness greater than 55. The outer mantle layer 14*b* is disposed over the inner mantle layer 14*a*, comprises an ionomer material and has a Shore D hardness greater than 60. The cover layer 16 is disposed over the mantle component 14, comprises a thermoplastic polyurethane material and has a Shore A hardness less than 100. The golf ball 10 has a diameter of at least 1.68 inches. The outer mantle layer 14*b* is harder than the inner mantle layer 14*a*, the inner mantle layer 14*a* is harder than the outer core layer 12*c*, the outer core layer 12*c* is harder than the intermediate core layer 12*b*, the intermediate core layer 12*b* is harder than the inner core sphere 12*a*, and the cover layer 16 is softer than the outer mantle layer 14*b*.

Various aspects of the present invention golf balls have been described in terms of certain tests or measuring procedures. These are described in greater detail as follows.

As used herein, "Shore D hardness" of the golf ball layers is measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

All of the following listed patent applications are hereby incorporated by reference in their entireties: U.S. patent application Ser. No. 13/451,160, filed on Apr. 19, 2012; U.S. patent application Ser. No. 13/091,937, filed on Apr. 21, 2011; U.S. patent application Ser. No. 13/253,299, filed on Oct. 5, 2011; U.S. patent application Ser. No. 13/269,208, filed on Oct. 7, 2011; and U.S. patent application Ser. No. 13/253,281, filed on Oct. 5, 2011.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A golf ball comprising:

a core comprising a thermoplastic polyester elastomer formed from a polytetramethylene glycol with a molecular weight greater than or equal to 1400 g/mol;

an inner mantle layer disposed over the outer core, the inner mantle layer having a thickness ranging from 0.030 inch to 0.070 inch, the inner mantle layer comprising an ionomer material, the inner mantle layer material having a plaque Shore D hardness ranging from 55 to 65;

an outer mantle layer disposed over the inner mantle layer, the outer mantle layer having a thickness ranging from 0.025 inch to 0.040 inch, the outer mantle layer comprising an ionomer material, the outer mantle layer material having a plaque Shore D hardness ranging from 65 to 71; and a cover layer disposed over the outer mantle layer, the cover having a thickness ranging from 0.025 inch to 0.040 inch, the cover composed of a thermoplastic polyurethane material, the cover material having a plaque Shore D hardness ranging from 40 to 50, and the on cover Shore D hardness less than 56;

wherein the golf ball has a diameter of at least 1.68 inches and a coefficient of restitution of at least 0.79.

2. A golf ball comprising:

a core comprising an inner core and an outer core disposed over the inner core, the inner core a thermoplastic polyester elastomer formed from a polytetramethylene glycol with a molecular weight greater than or equal to 1400 g/mol and the outer core comprising a polybutadiene material;

an inner mantle layer disposed over the outer core, the inner mantle layer having a thickness ranging from 0.030 inch to 0.070 inch, the inner mantle layer comprising a highly neutralized ionomer material, the inner mantle layer material having a plaque Shore D hardness ranging from 35 to 55;

an outer mantle layer disposed over the inner mantle layer, the outer mantle layer having a thickness ranging from 0.025 inch to 0.040 inch, the outer mantle layer comprising an ionomer material, the outer mantle layer material having a plaque Shore D hardness ranging from 65 to 71; and a cover layer disposed over the outer mantle layer, the cover having a thickness ranging from 0.025 inch to 0.040 inch, the cover composed of a thermoplastic polyurethane material, the cover material having a plaque Shore D hardness ranging from 40 to 50, and the on cover Shore D hardness less than 56;

wherein the golf ball has a diameter of at least 1.68 inches and a coefficient of restitution of at least 0.79.

3. The golf ball according to claim 2 wherein the mantle layer has a thickness ranging from 0.030 inch to 0.070 inch, and a plaque Shore D hardness ranging from 55 to 65.

4. The golf ball according to claim 2 wherein the cover layer has a thickness ranging from 0.025 inch to 0.040 inch and a plaque Shore A hardness ranging from 98 to 80.

* * * * *